US005294206A

United States Patent [19]

Mukunoki

[11] Patent Number: 5,294,206

[45] Date of Patent: Mar. 15, 1994

[54] LIQUID APPLICATION WITH RESILIENT SUPPORT

[75] Inventor: Tadashi Mukunoki, Toyonaka, Japan

[73] Assignee: Kabushiki Kaisha Sakura Kurepasu, Osaka, Japan

[21] Appl. No.: 964,882

[22] Filed: Oct. 22, 1992

[30] Foreign Application Priority Data

Oct. 29, 1991 [JP] Japan ..... 3-88765[U]

[51] Int. Cl.[5] ..... B43K 8/02

[52] U.S. Cl. ..... 401/206; 401/54; 401/81; 401/214

[58] Field of Search ..... 401/54, 81, 206, 214

[56] References Cited

U.S. PATENT DOCUMENTS 4,251,164 2/1981 Nakagawa et al. ..... 401/214 X

FOREIGN PATENT DOCUMENTS 1228162 11/1966 Fed. Rep. of Germany ..... 401/54
646559 11/1928 France ..... 401/54
55-10789 1/1980 Japan ..... 401/81
628350 8/1949 United Kingdom .
630609 10/1949 United Kingdom ..... 401/214
669464 4/1952 United Kingdom .
989954 4/1965 United Kingdom .

*Primary Examiner*—Steven A. Bratlie
*Attorney, Agent, or Firm*—Fish & Richardson

[57] ABSTRACT

A liquid applicator includes a tubular casing, a liquid holding member, and a support member. The support member whose modulus of elasticity is smaller than that of the liquid holding member is provided between a bottom end portion of the liquid holding member and a bottom wall of the casing. The support is formed such that at least a portion of an outer circumferential surface of the support member is in pressing contact with an inner circumferential surface of the casing and that the support member is compressively deformable in an axial direction thereof while being held tightly between the liquid holding member and the bottom wall of the casing. Accordingly, the liquid holding member can be reliably supported in the casing.

11 Claims, 4 Drawing Sheets

LIQUID APPLICATION WITH RESILIENT SUPPORT

BACKGROUND OF THE INVENTION AND RELATED ART STATEMENT

This invention relates to liquid applicators including writing instruments such as ball-point pens and paint markers.

In general, the liquid applicators are each provided with a casing for accommodating a liquid holding member such as an ink reservoir. This casing is constructed such that an opening is provided at a lead end thereof while a bottom wall is provided at a bottom end thereof. These liquid applicators require a structure for supporting the liquid holding member in a specified position of the casing.

Japanese Unexamined Utility Model Publication No. 1-80391 discloses a liquid applicator in which a support member is provided between a bottom end of a liquid holding member and a bottom wall of a casing so as to support the liquid holding member. This support member is formed of flexible material such as plastics and has a plurality of support pieces extending outwardly, thereby forming a bell-like shape at a lead end thereof. The support member is pressingly fit into the casing with these support pieces warped radially inward.

Further, Japanese Unexamined Utility Model Publication No. 46-2727 discloses a liquid applicator in which a spring is provided between a bottom end of an ink cartridge serving as a liquid holding member and a bottom wall of a casing so as to support and bias the ink cartridge constantly toward the lead end of the applicator.

The support member disclosed in the former publication is complicated in its shape and accordingly it is difficult to mold the same. Further, this support member makes almost no deformation in an axial direction of the liquid applicator. This makes the assembling of the liquid applicator as a whole difficult even when the axial dimension of support member is only slightly greater than a specified dimension, and also leads to a compressive deformation of the liquid holding member in the case where the liquid holding member is soft, thereby hindering the liquid from flowing in a satisfactory manner. In view of the above, the axial dimension of the support member is forced to be set smaller than the specified dimension, with the result that a clearance is defined between the support member and a bottom face of the liquid holding member. Therefore, these members cannot be properly positioned relative to each other.

On the other hand, the liquid applicator disclosed in the latter publication requires a special means for positioning the spring lest the spring should be displaced in the radial direction of the applicator because there is a clearance between the spring and an inner circumferential surface of the casing. This requirement makes the construction of the liquid applicator complicated.

SUMMARY OF THE INVENTION

In view of these problems existing in the prior art, it is an object of the invention to provide a liquid applicator having a simply structured support member for reliably supporting a liquid holding member in a casing of the liquid applicator.

Accordingly, a liquid applicator of the invention comprises a tubular casing having an opening defined at a lead end thereof and having a bottom wall at a bottom end thereof; a liquid holding member which is contained in the casing: and a support member provided between a bottom end of the liquid holding member and the bottom wall of the casing, the support member having a modulus of elasticity smaller than that of the liquid holding member and being formed such that at least a portion of an outer circumferential surface of the support member is in pressing contact with an inner circumferential surface of the casing and that the support member is compressively deformable in an axial direction thereof while being held tightly between the liquid holding member and the bottom wall of the casing.

With the liquid applicator thus constructed, being constantly in pressing contact with the support member, the liquid holding member can be reliably supported. This prevents the liquid holding member and the support member from moving relative to each other in the casing. Further, since the bottom end portion of the liquid holding member is pressed against the elastic support member, thereby forming a recessed portion on the support member, the radial displacement of the liquid holding member relative to the support member can be also restricted.

It is preferably to form the support member of elastic material such as rubber and sponge. Particularly, if the support member is formed of open cell type sponge, there can be obviated the need to provide a special means for supplying the air to a main body of the liquid holding member. Thus formed support member is also advantageous in preventing leakage of ink toward the lead end of the liquid applicator because excess ink from the liquid holding member is soaked up with this support member.

Further, a recessed portion in which the bottom end portion of the liquid holding member is fitted may be formed on the lead end face of the support member. This is effective in reliably preventing the displacement of the liquid holding means relative to the support member.

The specific form of the support member does not particularly matter. However, in the case where the liquid holding member includes a main body and a cover for covering an outer circumferential surface of this main body, it may be advantageous to form on the lead end face of the support member a communication groove which functions to cause the bottom end face of the main body of the liquid holding member to communicate with the plenum in the casing. Alternatively, the support member may be formed such that the bottom end face of the main body of the liquid holding member bulges out of the lead end face of the support member. With this arrangement, the main body of the liquid holding member is permitted to communicate with the plenum in the casing despite the fact that the lead end face of the support member is entirely in pressing contact with the liquid holding member, and thereby the air can be smoothly supplied to the main body liquid holding member.

These and other objects, features and advantages of the present invention will become more apparent upon a reading of the following detailed description and accompanying drawings.

DETAILED DESCRIPTION OF PREFERRED EMBODIMENTS OF THE INVENTION

An exemplary embodiment of the invention will be described in accordance with FIGS. 1 and 2. The invention is applied to a paint marker in this embodiment. However, the invention is not limited to this application, but also applicable to various types of liquid applicators in which liquids are contained in casings thereof.

Figure 1:
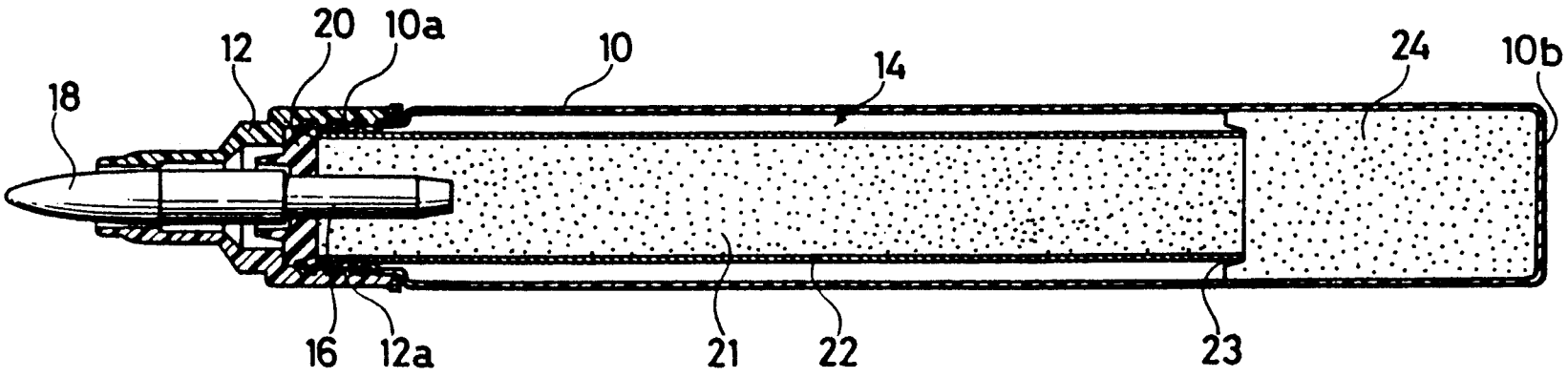
FIG. 1 is a front view in section showing an essential portion of a liquid applicator embodying the invention.
Figure 2:
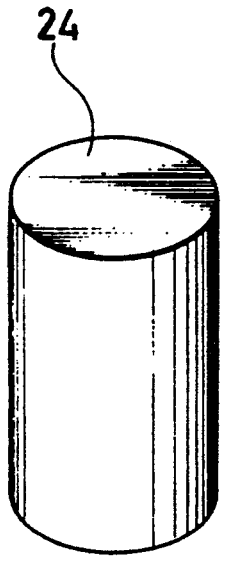
FIG. 2 is a perspective view showing a support member provided in the liquid applicator.

A liquid applicator shown in FIG. 1 is provided with a tubular casing 10 and a hollow lead portion 12 having a bore in communication with the plenum in the casing 10. The casing 10 has an opening at a top end thereof and a bottom wall 10*b* at a bottom end thereof. The lead portion 12 is mounted in such a position as to block the opening of the casing 10. More specifically, an external thread 10*a* is formed on an outer circumferential surface of a lead end portion of the casing 10 and an internal thread 12*a* is formed on an inner circumferential surface of a bottom end portion of the lead portion 12. The casing 10 and the lead portion 12 are coupled with each other by spirally engaging these threads 10*a*, 12*a*.

In the casing 10 is contained an ink reservoir (liquid holding member) 14 for holding ink (liquid to be applied). This ink reservoir 14 includes a column-like main body 21 made of a bundle of fibers or the like and a tubular cover 22 made of polyethylene film or the like for covering an outer circumferential surface of the main body 21. left end face and a right end face (FIG. 1) of the main body 21 are not covered by the cover 22, thereby being exposed. The lead end of the main body 21 is connected with a shaft 16 extending from a bottom end of a nib 18, and a lead end of the nib 18 is projecting forward from the lead portion 12. Further, between the casing 10 and the lead portion 12 is provided a seal member 20 made of elastic material such as rubber and polyethylene resin.

The feature of this liquid applicator is a support member 24 which is pressingly fitted between the bottom end of the ink reservoir 14 and the bottom wall 10*b* of the casing 10. This support member 24 is made of rubber or sponge which is relatively subject to elastic deformation, and configured into a cylindrical form as shown in FIG. 2. The support member 24 is formed such that the axial dimension thereof is slightly greater in its natural state than the distance between the bottom end face of the ink reservoir 14 and an inner face of the bottom wall 10*b* in an assembled state. Further, the diameter of the support member 24 in the natural state is slightly greater than the inner diameter of the casing 10 on condition that the support member 24 is pressingly insertable into the interior of the casing 10 through the opening thereof. The liquid applicator is assembled in the following order: 1) The support member 24 is pressingly inserted into the casing 10 through the opening thereof up to a position where the member 24 comes to contact with the bottom wall 10*b*; 2) The ink reservoir 14 is inserted into the casing 10; and 3) The lead portion 12 is spirally coupled with the casing 10 while causing the seal member 20 to press the ink reservoir 14 inside from the lead end. In the assembled state, the ink reservoir 14 has opposite ends thereof tightly held by the seal members 20 and the support member 24, and the support member 24 is held tightly between the bottom face of the ink reservoir 14 and the bottom wall 10*b*, thereby deforming compressively in the axial direction.

With this construction, the liquid applicator can be assembled such that the ink reservoir 14 and the support member 24 are constantly in pressing contact with each other because the support member 24 deforms compressively in the axial direction according to the distance between the ink reservoir 14 and the bottom wall 10*b*. The ink reservoir 14 can be pressed toward the lead end of the liquid applicator by the elastic force rendered from the support member 24 in a deformed state, and thereby the support member 24 can support the ink reservoir 14 reliably. Further, the variation of the distance between the ink reservoir 14 and the bottom wall 10*b* is absorbed by the compressive deformation of the support member 24. This obviates the high accuracy requirement for the axial dimensions of the respective members, thereby facilitating the manufacturing of the liquid applicator. In addition, the shape of the support member 24 itself is simple and easy to be molded.

Further, since the elastic support member 24 is in pressing contact with the ink reservoir 14, a contact portion thereof with the ink reservoir 14 is indented, thereby forming a recessed portion 23. The bottom end portion of the ink reservoir is fitted and held in this recessed portion 23. In view of this, the recessed portion 23 is advantageous in restricting a radial displacement of the ink reservoir 14 relative to the support member 24.

Moreover, the support member 24 is contained in the casing 10 while being compressed in the radial direction of the liquid applicator, i.e. in a state where the outer circumference surface of the support member 24 is in pressing contact with the inner circumferential surface of the casing 10. Accordingly, the support member 24 is prevented from moving radially without providing any special structure.

It does not matter which specific material is used to form the support member 24, but it is important to use material at least whose modulus of elasticity is smaller than that of the ink reservoir 14 in order to prevent the ink reservoir 14 from deforming compressively in the assembled state. In the construction shown in FIG. 1, the support member 24 may be formed of elastic material which is more subject to the elastic deformation than the cover 22 which is the harder part of the ink reservoir 14.

In the case where sponge is selected as material for the support member 24, the ink held by the ink reservoir 14 can be prevented from transferring to the support member 24 if the closed cell type sponge is used. However, in this case, it is very preferable to omit the cover 22, to form the cover 22 of material through which the air is permeable such as an unwoven cloth, or to form an air hole in a specified position of the cover 22, so that the air in the casing 10 is supplied to the main body 21 while the ink is being applied. On the contrary, the use of the open cell type sponge has the following advantages: 1) There can be obviated the need for a special means for supplying the air to the main body 21; and 2) Since excess ink from the ink reservoir 14 is soaked up with the support member 24, leakage of ink toward the nib 18 can be prevented.

It does not matter which specific shape the support member 24 takes either. The shape of the support member 24 will do so long as at least a portion of the outer circumferential surface of the support member 24 is in pressing contact with the inner circumferential surface of the casing 10, and the support member 24 is compressed in the axial direction.

Figure 3A:
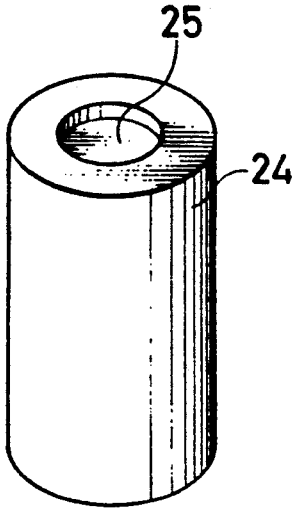
FIGS. 3A, 3B, 3C and 3D are perspective view showing modifications of the support member respectively.
Figure 3B:
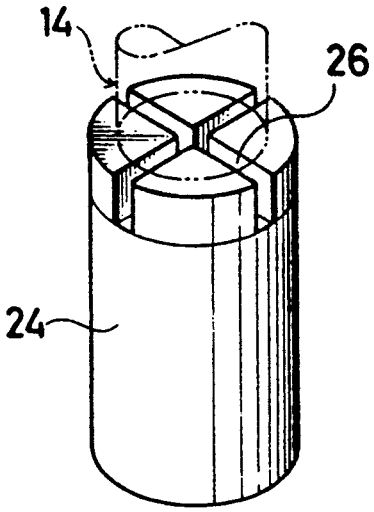
Figure 3C:
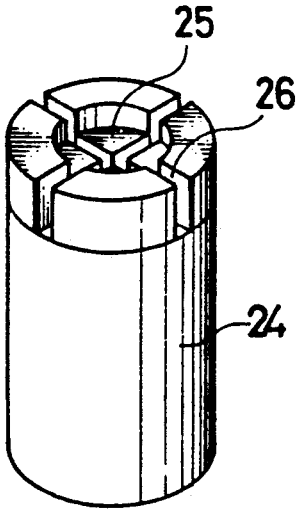

For instance, a recessed portion 25 may be actively formed on the lead end face of the support 24 as shown in FIG. 3A. If the bottom end portion of the ink reservoir 14 is fitted in this recessed portion 25, the radial displacement of the ink reservoir 14 relative to the support member can be prevented more reliably. Further, the support member 24 may have communication grooves 26 formed on the lead end face thereof, the grooves 26 extending diametrically and opening upward as shown in FIG. 3B. With these communication grooves 26, the bottom face of the main body 21 of the ink reservoir 14 is allowed to be exposed to the air in the casing 10 through the communication grooves 26 even in the state where the bottom face of the ink reservoir 14 is in pressing contact with the support member 24. Accordingly, even if the outer circumferential surface of the main body 21 is entirely covered by the cover 22, the air can be smoothly supplied to the main body 21 through the communication grooves 26 while the ink is being applied. Further, as shown in FIG. 3C, both the recessed portion 25 and the communication grooves 26 may be formed on the lead end face of the support member 24 in a combined manner.

Figure 3D:
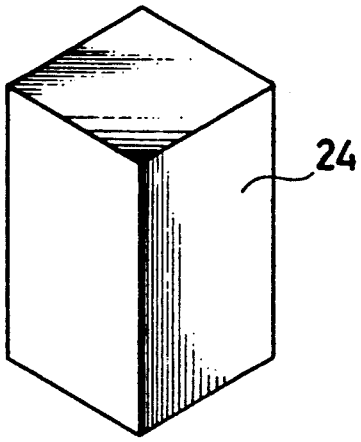
Figure 4:
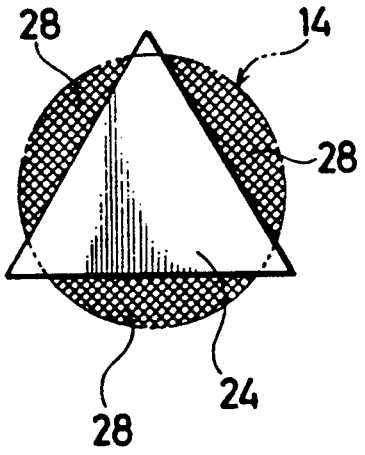
FIG. 4 is a diagram showing positional relationship between the support member in the form of a triangular column and an ink reservoir when viewed from an axial direction of the liquid applicator.

The overall shape of the support member 24 is not limited to a cylindrical shape, but may be polyhedrons including a rectangular column shown in FIG. 3D. In the case of the polyhedrons, the outer circumferential surface of the support member 24 are not in contact with the inner circumferential surface of the casing 10 entirely, but the outer circumferential surface of corner portions of the polyhedrons are deformed and thereby come to contact with the inner circumferential surface of the casing 10. Even in this state, the support member 24 can be positioned radially reliably, Further, in the case where the support member 24 is a polyhedral column, particularly a triangular column, an area 28 of the ink reservoir 14 bulging out of the support member 24 (crisscrossed area in FIG. 4) when viewed from the axial direction is increased as shown in FIG. 4. The air can be smoothly supplied to the main body 21 of the ink reservoir 14 through the area 28 without providing the aforementioned communication grooves 26 or the like specially for that purpose. Besides cases where the support member 24 is a polyhedral column, the above effect is obtainable provided that the bottom face of the main body 21 bulges out of the lead end face of the support member 24.

According to the invention, the liquid holding member is not limited to the ink reservoir 14 shown in FIG. 1, but may have various other structures so long as it is adapted to hold the liquid.

As described above, according to the invention, a support member whose modulus of elasticity is smaller than a liquid holding member is provided between a bottom end of the liquid holding member and a bottom wall of a casing of a liquid applicator. At least a portion of an outer circumferential surface of the support member is in pressing contact with an inner circumferential surface of the casing, and the support member is so formed as to deform compressively in a state where it is held tightly between the liquid holding member and the bottom wall of the casing. Accordingly, the liquid holding member can be supported reliably while bringing the liquid holding member and the support member into pressing contact with each other. This prevents the liquid holding member and the support member from moving relative to each other. In addition, a bottom end portion of the liquid holding member is pressed against and held in a recessed portion formed on the support member. This arrangement restricts a radial displacement of the liquid holding member relative to the support member.

Further, the variation of the distance between the liquid holding member and the bottom wall is absorbed by compressive deformation of the support member. This obviates the high accuracy requirement for the axial dimensions of the respective members, thereby facilitating the manufacturing of the liquid applicator. In addition, the shape of the support member 24 itself is simple and easy to be molded. Thus, a manufacturing cost can be reduced.

Moreover, this support member is contained in the casing while being compressed in the radial direction of the liquid applicator, i.e. in a state where the outer circumference surface of the support member are in pressing contact with the inner circumferential surface of the casing. Accordingly, the support member is prevented from moving radially without providing any special structure.

Further, by fitting the bottom end portion of the liquid holding member in the recessed portion formed on the lead end face of the support member, the radial displacement of the liquid holding member relative to the support member can be more reliably prevented.

Also, by forming a communication groove on the lead end face of the support member, or causing a main body of the liquid holding member to bulge out of the circumference of the support member, the main body of the liquid holding member is exposed to the air in the casing despite the fact that the support member is in pressing contact with the liquid holding member. Accordingly, even if the outer circumferential surface of the liquid holding member is covered entirely by a cover, the air can be smoothly supplied to the main body of the liquid holding member through the exposed area thereof.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A liquid applicator comprising:

a cylindrical casing having an opening defined at a lead end thereof and having a bottom wall at a bottom end thereof;

a liquid holding member which is contained in the casing; and a polyhedral support member provided between a bottom end of the liquid holding member and the bottom wall of the casing, the support member having a modulus of elasticity smaller than that of the liquid holding member and being formed such that vertices of the support member are in pressing contact with an inner circumferential surface of the casing and that the support member is compressively deformable in an axial direction thereof while being held tightly between the liquid holding member and the bottom wall of the casing, wherein the support member is formed of an elastic material.

2. A liquid applicator as defined in claim 1 wherein the support member is formed of open cell type sponge.

3. A liquid applicator as defined in claim 1, wherein a recessed portion in which the bottom end portion of the liquid holding member is fitted on a lead end face of the support member.

4. A liquid applicator as defined in claim 1 or 2 wherein the liquid holding member includes a main body and a cover for covering only an outer circumferential surface of the main body, and wherein a communication groove is formed on the lead end face of the support member so as to make the bottom end face of the main body of the liquid holding member communicate with the plenum in the casing.

5. A liquid applicator as defined in claim 1 or 2 wherein the liquid holding member includes a main body and a cover for covering only an outer circumferential surface of the main body, and wherein the support member is formed such that the bottom end face of the main body of the liquid holding member extends from the lead end face of the support member.

6. A liquid applicator as defined in claim 1, wherein the support member is in the form of a rectangular column.

7. A liquid applicator as defined in claim 1, wherein the liquid holding member includes a main body and a cover for covering only an outer circumferential surface of the main body, the liquid holding member being a cylindrical form having a diameter greater than the distance between the opposite sides of the polyhedral support member, whereby providing the liquid holding member with such bottom portions outside the polygonal top plane of the support member as to communicate with the plenum in the casing.

8. A liquid applicator as defined in claim 1, wherein the side wall of the casing has a neck portion having a first diameter and a main portion having a second diameter greater than the first diameter, the neck portion having a predetermined axial length for keeping the liquid holding member from moving in a radial direction.

9. A liquid applicator as defined in claim 1, wherein the material from which the support member is formed is selected from the group consisting of rubber and sponge.

10. A liquid applicator as defined in claim 3, wherein the liquid holding member includes a main body and a cover for covering only an outer circumferential surface of the main body, and wherein a communication groove is formed on the lead end face of the support member so as to make the bottom end face of the main body of the liquid holding member communicate with a plenum in the casing.

11. A liquid applicator as defined in claim 4, wherein the liquid holding member includes a main body and a cover for covering only an outer circumferential surface of the main body, and wherein the support member is formed such that the bottom end face of the main body of the liquid holding member extends from the lead end face of the support member.

* * * * *